US010883253B2

(12) United States Patent
Cho

(10) Patent No.: US 10,883,253 B2
(45) Date of Patent: Jan. 5, 2021

(54) METHOD FOR CONTROLLING SWING MOTOR IN HYDRAULIC SYSTEM AND HYDRAULIC SYSTEM

(71) Applicant: Doosan Infracore Co., Ltd., Incheon (KR)

(72) Inventor: Yong Lak Cho, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 709 days.

(21) Appl. No.: 15/128,869

(22) PCT Filed: Mar. 12, 2015

(86) PCT No.: PCT/KR2015/002403

§ 371 (c)(1),
(2) Date: Sep. 23, 2016

(87) PCT Pub. No.: WO2015/147464

PCT Pub. Date: Oct. 1, 2015

(65) Prior Publication Data

US 2017/0107691 A1 Apr. 20, 2017

(30) Foreign Application Priority Data

Mar. 24, 2014 (KR) ..... 10-2014-0034092

(51) Int. Cl.
*E02F 9/12* (2006.01)
*E02F 9/22* (2006.01)
(Continued)

(52) U.S. Cl.
CPC ..... *E02F 9/123* (2013.01); *E02F 9/2004* (2013.01); *E02F 9/2228* (2013.01);
(Continued)

(58) Field of Classification Search
CPC ..... E02F 9/123; E02F 9/2004; E02F 9/2228; E02F 9/2267; E02F 9/2296; E02F 9/2292;
(Continued)

(56) References Cited

U.S. PATENT DOCUMENTS 5,025,626 A * 6/1991 Crosser ..... E02F 9/2214 60/450
5,062,266 A * 11/1991 Yoshimatsu ..... B66C 23/86 60/466
(Continued)

FOREIGN PATENT DOCUMENTS

JP H10-168948 A 6/1998
JP 2006-064110 A 3/2006
(Continued)

OTHER PUBLICATIONS

KR 20080045314—English Translation (Translated to English by EPO and Google, retrieved from https://worldwide.espacenet.com/ on Jul. 2, 2019).*
(Continued)

*Primary Examiner* — Thomas E Lazo
*Assistant Examiner* — Daniel S Collins
(74) *Attorney, Agent, or Firm* — K&L Gates LLP

(57) ABSTRACT

The present disclosure relates to a method for controlling a swing motor in a hydraulic system and a hydraulic system. The method for controlling the swing motor in the hydraulic system and the hydraulic system according to the exemplary embodiment of the present disclosure may ensure the sufficient amount of hydraulic oil in a make-up line in a situation in which the hydraulic oil needs to be supplementarily supplied to the swing motor in the hydraulic system. Therefore, it is possible to prevent the occurrence of cavitation in the swing motor by stably supplying the amount of hydraulic oil at the point in time where the hydraulic oil
(Continued)

needs to be supplementarily supplied to the swing motor. In addition, it is possible to prevent the occurrence of abnormal noise which is harsh to the ear when the cavitation occurs.

11 Claims, 10 Drawing Sheets

(51) Int. Cl.
*F15B 11/17* (2006.01)
*E02F 9/20* (2006.01)
*F15B 11/08* (2006.01)
*F15B 13/04* (2006.01)

(52) U.S. Cl.
CPC ..... *E02F 9/2267* (2013.01); *E02F 9/2285* (2013.01); *E02F 9/2292* (2013.01); *E02F 9/2296* (2013.01); *F15B 11/08* (2013.01); *F15B 11/17* (2013.01); *F15B 13/0401* (2013.01); *F15B 2211/20546* (2013.01); *F15B 2211/20553* (2013.01); *F15B 2211/20576* (2013.01); *F15B 2211/41554* (2013.01); *F15B 2211/45* (2013.01); *F15B 2211/575* (2013.01); *F15B 2211/613* (2013.01); *F15B 2211/6316* (2013.01); *F15B 2211/67* (2013.01); *F15B 2211/7058* (2013.01); *F15B 2211/7135* (2013.01); *F15B 2211/7142* (2013.01); *F15B 2211/853* (2013.01); *F15B 2211/8609* (2013.01); *F15B 2211/8616* (2013.01)

(58) Field of Classification Search
CPC . E02F 9/2285; E02F 9/128; E02F 9/08; E02F 9/12; E02F 9/20; F15B 13/0401; F15B 11/08; F15B 11/17
USPC ..... 60/468; 91/38
See application file for complete search history.

(56) References Cited

U.S. PATENT DOCUMENTS 5,063,742 A * 11/1991 Yoshimatsu ..... E02F 9/123 60/466
5,571,226 A * 11/1996 Kobayashi ..... E02F 9/2228 37/348
5,636,516 A * 6/1997 Kon ..... E02F 9/123 60/466
5,862,665 A * 1/1999 Maruyama ..... E02F 9/123 60/468
5,941,155 A * 8/1999 Arai ..... E02F 9/123 60/468
5,996,341 A * 12/1999 Tohji ..... E02F 9/2203 60/421
6,378,303 B1 * 4/2002 Higuchi ..... E02F 9/2235 60/468
7,178,333 B2 * 2/2007 Oka ..... E02F 9/2239 60/421
7,594,395 B2 * 9/2009 Oka ..... F15B 11/17 60/421
8,511,490 B2 * 8/2013 Kawai ..... B66C 23/86 212/235
9,051,712 B2 * 6/2015 Kodaka ..... E02F 3/962
9,618,018 B2 * 4/2017 An ..... E02F 9/2217
9,809,958 B2 * 11/2017 Shang ..... E02F 9/2217
10,106,955 B2 * 10/2018 Shiratani ..... E02F 9/2285
10,233,613 B2 * 3/2019 Honda ..... E02F 9/22
2004/0244232 A1 * 12/2004 Toji ..... E02F 9/2228 37/348
2005/0072474 A1 * 4/2005 Jervis ..... E02F 9/2207 137/512.1
2013/0028695 A1 1/2013 Blakeman
2013/0058750 A1 * 3/2013 Hiroki ..... E02F 9/123 414/744.2
2014/0325975 A1 * 11/2014 Kim ..... F15B 21/14 60/414
2015/0013318 A1 * 1/2015 Lee ..... E02F 9/123 60/394
2015/0219123 A1 * 8/2015 Nishikawa ..... E02F 9/123 60/393
2015/0292183 A1 * 10/2015 Hiraku ..... F15B 11/17 60/423
2018/0105061 A1 * 4/2018 Egawa ..... E02F 9/20

FOREIGN PATENT DOCUMENTS

KR 10-2003-0051004 A 6/2003
KR 20080045314 A * 5/2008
KR 10-2010-0020568 A 2/2010
KR 20120120056 11/2012
KR 10-2013-0087165 A 8/2013
WO WO-2016098335 A1 * 6/2016 ..... E02F 9/20

OTHER PUBLICATIONS

WO 2016098335—English Translation (Translated to English by EPO and Google, retrieved from https://worldwide.espacenet.com/ on Jul. 2, 2019).*
International Search Report (with English translation) issued in international application No. PCT/KR2015/002403, dated May 29, 2015, 5 pages.
Written Opinion issued in international application No. PCT/KR2015/002403, dated May 29, 2015, 8 pages.
Extended European Search Report issued in related European patent application No. 15769217.9 dated Feb. 2, 2018.

* cited by examiner

METHOD FOR CONTROLLING SWING MOTOR IN HYDRAULIC SYSTEM AND HYDRAULIC SYSTEM

CROSS REFERENCE TO RELATED APPLICATIONS

The present application is a National Stage of International Application No. PCT/KR2015/002403, filed on Mar. 12, 2015, which claims priority to Korean Patent Application No. 10-2014-0034092, filed on Mar. 24, 2014, the entire contents of each of which are being incorporated herein by reference.

TECHNICAL FIELD

The present disclosure relates to a method for controlling a swing motor in a hydraulic system and a hydraulic system, and more particularly, to a method for controlling a swing motor in a hydraulic system and a hydraulic system, which are capable of preventing the occurrence of cavitation in the swing motor by supplying hydraulic oil to the swing motor when the swing motor stops after rotating.

BACKGROUND ART

In general, a construction machine is provided with a swing motor that allows an upper body to turn relative to a lower body. The swing motor rotates by being supplied with hydraulic oil by an operation of a joystick. When the joystick is positioned in a neutral position so that the joystick is not operated, the upper body stops turning. Hereinafter, the "swing motor" will be simply referred to as a "motor".

However, even in a case in which the joystick is operated to stop the turning of the upper body, the upper body does not immediately stop turning, but the upper body may turn slightly further due to inertia.

Meanwhile, because the joystick is not operated any more, the supply of hydraulic oil to the motor stops. However, the upper body may still rotate due to inertia as described above. Since the upper body still turns, a shaft of the motor is rotated, and as a result, the hydraulic oil is drawn into an inlet of the motor, and the hydraulic oil is discharged from an outlet of the motor.

In the case of a hydraulic circuit of the motor in the related art, hydraulic oil discharged from the outlet of the motor may flow toward the inlet f the motor. However, the hydraulic oil may leak in the motor, and thus the amount of hydraulic oil may be insufficient in the inlet of the swing motor.

Due to the insufficient amount of hydraulic oil, pressure may be decreased, and pressure lower than permissible pressure may be formed in a designated hydraulic line, such that cavitation occurs when pressure in the hydraulic system becomes lower than the permissible pressure as described above.

In addition, noise, which is harsh to the ear, may occur when pressure abnormally decreases in the hydraulic circuit of the motor, and the noise may cause an operator to suffer from stress.

LITERATURE OF RELATED ART (Patent Literature 1) Korean Patent Application Laid-Open No. 10-2010-0020568 (Feb. 23, 2010)

(Patent Literature 2) Korean Patent Application Laid-Open No. 10-2012-0120056 (Nov. 1, 2012)

DISCLOSURE

Technical Problem

Accordingly, a technical problem to be solved by the present disclosure is to provide a method for controlling a swing motor in a hydraulic system, which is capable of preventing the occurrence of cavitation in the swing motor by supplying the swing motor with hydraulic oil, which is basically discharged from a hydraulic pump, even when a joystick for controlling the swing motor is not operated any more.

Technical problems to be solved by the present disclosure are not limited to the aforementioned technical problem, and other technical problems, which are not mentioned above, may be clearly understood from the following descriptions by those skilled in the art to which the present disclosure pertains.

Technical Solution

To solve the aforementioned problem, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an "On" state, and to disconnect the auxiliary pump from the bypass cut valve in an "Off" state; a joystick which is operated to supply the pilot hydraulic oil to the control valve unit; and a control unit which controls the bypass control valve, in which the bypass control valve is controlled such that after the bypass control valve is maintained in the "On" state during a first delay time D1 from a point in time $t_1$ where a first pressure Ps is formed in a pilot line by the operation of the joystick, the state of the bypass control valve is changed to the "Off" state, and the state of the bypass control valve is changed from the "Off" state to the "On" state at a point in time t3 where the pressure formed in the pilot line is decreased and reaches a second pressure Pe lower than the first pressure Ps, and then the bypass control valve is maintained in the "On" state during a second delay time D7.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an "On" state, and to disconnect the auxiliary pump from the bypass cut valve in an "Off" state; a joystick which is operated to supply the pilot hydraulic oil to the control valve unit; and a control unit which controls the bypass control valve, in which the bypass control valve is controlled such that after the bypass control valve is maintained in the "On" state during a first delay time D1' from a point in time $t_{11}$ where a first pressure Ps is formed in a pilot line by the operation of the joystick and a swivel angle of a swash plate of the main pump reaches a preset angle θs, the state of the bypass control valve is changed to the "Off" state, and the state of the bypass control valve is changed from the "Off" state to the "On" state at a point in time t3 where the pressure formed in the pilot line is decreased and reaches a second pressure Pe lower than the first pressure Ps, and then the bypass control valve is maintained in the "On" state during a second delay time D2.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an "On" state, and to disconnect the auxiliary pump from the bypass cut valve in an "Off" state; a joystick is operated to supply the pilot hydraulic oil to the control valve unit; and a control unit which controls the bypass control valve, in which the bypass control valve is controlled such that after the bypass control valve is maintained in the "On" state from a point in time $t_1$ where a first pressure Ps is formed in a pilot line by the operation of the joystick to a point in time t3 where the pressure formed in the pilot line is decreased and reaches a second pressure Pe lower than the first pressure Ps, the state of the bypass control valve is changed to the "Off" state at the point in time t3 where the pressure formed in the pilot line reaches the second pressure Pe, and the bypass control valve is maintained in the "Off" state during a delay time D, and then the state of the bypass control valve is changed to the "On" state.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an "On" state, and to disconnect the auxiliary pump from the bypass cut valve in an "Off" state; a joystick which is operated to supply the pilot hydraulic oil to the control valve unit; and a control unit which controls the bypass control valve, in which the bypass control valve is controlled such that after the bypass control valve is maintained in the "On" state from a point in time $t_{11}$ where a first pressure Ps is formed in a pilot line by the operation of the joystick and a swivel angle of a swash plate of the main pump reaches a preset angle θs to a point in time t3 where the pressure formed in the pilot line is decreased and reaches a second pressure Pe lower than the first pressure Ps, the state of the bypass control valve is changed to the "Off" state at the point in time t3 where the pressure formed in the pilot line reaches the second pressure Pe, and the bypass control valve is maintained in the "Off" state during a delay time D, and then the state of the bypass control valve is changed to the "On" state.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, in which the magnitude of the electric current value applied to the bypass control valve is controlled such that the magnitude of the electric current value is decreased from a first electric current value a second electric current value after a first delay time D1 has passed from a point in time $t_1$ where a first pressure Ps is formed in a pilot line by the operation of the joystick, and the magnitude of the electric current value is increased from the second electric current value to the first electric current value after a second delay time D2 has passed from a point in time t3 where the pressure formed in the pilot line is decreased and reaches a second pressure Pe lower than the first pressure Ps.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, in which the magnitude of the electric current value applied to the bypass control valve is controlled such that the magnitude of the electric current value is decreased from a first electric current value to a second electric current value after a first delay time D1' has passed from a point in time $t_{11}$ where a first pressure Ps is formed in a pilot line by the operation of the joystick and a swivel angle of a swash plate of the main pump reaches a preset angle θs, and the magnitude of the electric current value is increased from the second electric current value to the first electric current value after a second delay time D2 has passed from a point in time t3 where the pressure formed in the pilot line is decreased and reaches a second pressure Pe lower than the first pressure Ps.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, in which the magnitude of the electric current value applied to the bypass control valve is controlled such that after the magnitude of the electric current value is maintained as a first electric current value from a point in time $t_1$ where a first pressure Ps is formed in a pilot line by the operation of the joystick to a point in time t3 where the pressure formed in the pilot line is decreased and reaches a second pressure Pe lower than the first pressure Ps, the magnitude of the electric current value is decreased to a second electric current value during a delay time D, and the magnitude of the electric current value is increased from the second electric current value to the first electric current value after the delay time D has passed, and then the first electric current value is maintained.

In addition, the present disclosure may provide a method for controlling a swing motor in a hydraulic system, the hydraulic system including: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pup and the bypass cut valve when electric current is applied; a joystick which is operated to supply the pilot hydraulic oil to the control valve unit; and a control unit which controls the bypass control valve, in which the magnitude of the electric current value applied to the bypass control valve is controlled such that after the magnitude of the electric current value is maintained as a first electric current value from a point in time where a first pressure Ps is formed in a pilot line by the operation of the joystick and a swivel angle of a swash plate of the main pump reaches a preset angle θs to a point in time t3 where the pressure formed in the pilot line is decreased and reaches a second pressure Pe lower than the first pressure Ps, the magnitude of the electric current value is decreased to a second electric current value during a delay time D, and the magnitude of the electric current value is increased from the second electric current value to the first electric current value after the delay time D has passed, and then the first electric current value is maintained.

In this case, a downward gradient S1 may be set when the magnitude of the electric current value applied to the bypass control valve is changed from the first electric current value to the second electric current value, and an upward gradient S2 may be set when the magnitude of the electric current value is changed from the second electric current value to the first electric current value.

In addition, the present disclosure may provide a hydraulic system which adopts the method for controlling the swing motor.

Advantageous Effects

The method for controlling the swing motor in the hydraulic system and the hydraulic system according to the present disclosure, which are configured as described above, may ensure the sufficient amount of hydraulic oil in a make-up line in a situation in which the hydraulic oil needs to be supplementaily supplied to the swing motor in the hydraulic system of a closed center type in which there is no bypass hydraulic oil. Therefore, it is possible to prevent the occurrence of cavitation in the swing motor by stably supplying the amount of hydraulic oil at the point in time where the hydraulic oil needs to be supplementarily supplied to the swing motor. In addition, it is possible to prevent the occurrence of abnormal noise which is harsh to the ear when the cavitation occurs.

DESCRIPTION OF MAIN REFERENCE NUMERALS OF DRAWINGS

Figure 1:
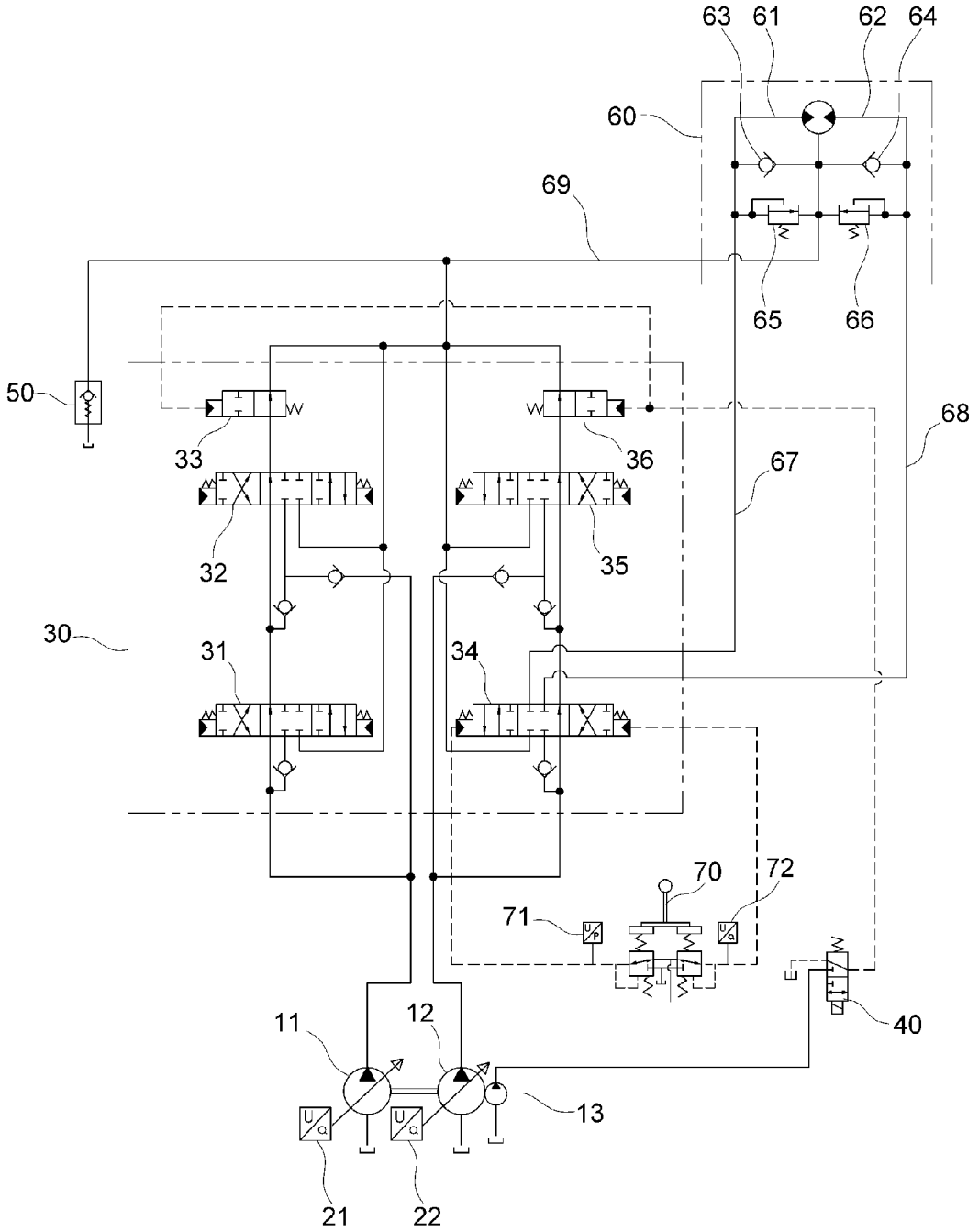
FIG. 1 is a view illustrating a hydraulic circuit for explaining a hydraulic system of a swing motor according to a first exemplary embodiment of the present disclosure.

11, 12: First and second main pumps
13: Auxiliary pump
21, 22: First and second swash plate swivel angle detecting units
30: Main control valve
31, 32, 34, 35: First, second, third, and fourth control valve units
33, 36: First and second bypass cut valves
40, 41: Bypass control valve
50: Bypass check valve
60: Swing motor
61, 62: First and second ports
63, 64: First and second check valves
65, 66: First and second relief valves
67, 68: First and second hydraulic lines

69: Make-up line
70: Joystick
71, 72: First and second joystick pressure sensors

BEST MODE

Advantages and features of the present disclosure and methods of achieving the advantages and features will be clear with reference to exemplary embodiments described in detail below together with the accompanying drawings.

Hereinafter, an exemplary embodiment of the present disclosure will be described in detail with reference to the accompanying drawings. It should be appreciated that the exemplary embodiments, which will be described below, are illustratively described to help understand the present disclosure, and the present disclosure may be variously modified to be carried out differently from the exemplary embodiments described herein. However, in the description of the present disclosure, the specific descriptions and illustrations of publicly known functions or constituent elements will be omitted when it is determined that the specific descriptions may unnecessarily obscure the subject matter of the present disclosure. In addition, to help understand the present disclosure, the accompanying drawings are not illustrated based on actual scales, but parts of the constituent elements may be exaggerated in size.

Meanwhile, the terms used in the description are defined considering the functions of the present disclosure and may vary depending on the intention or usual practice of a manufacturer. Therefore, the definitions should be made based on the entire contents of the present specification.

Like reference numerals indicate like elements throughout the specification.

First Exemplary Embodiment

Figure 2:
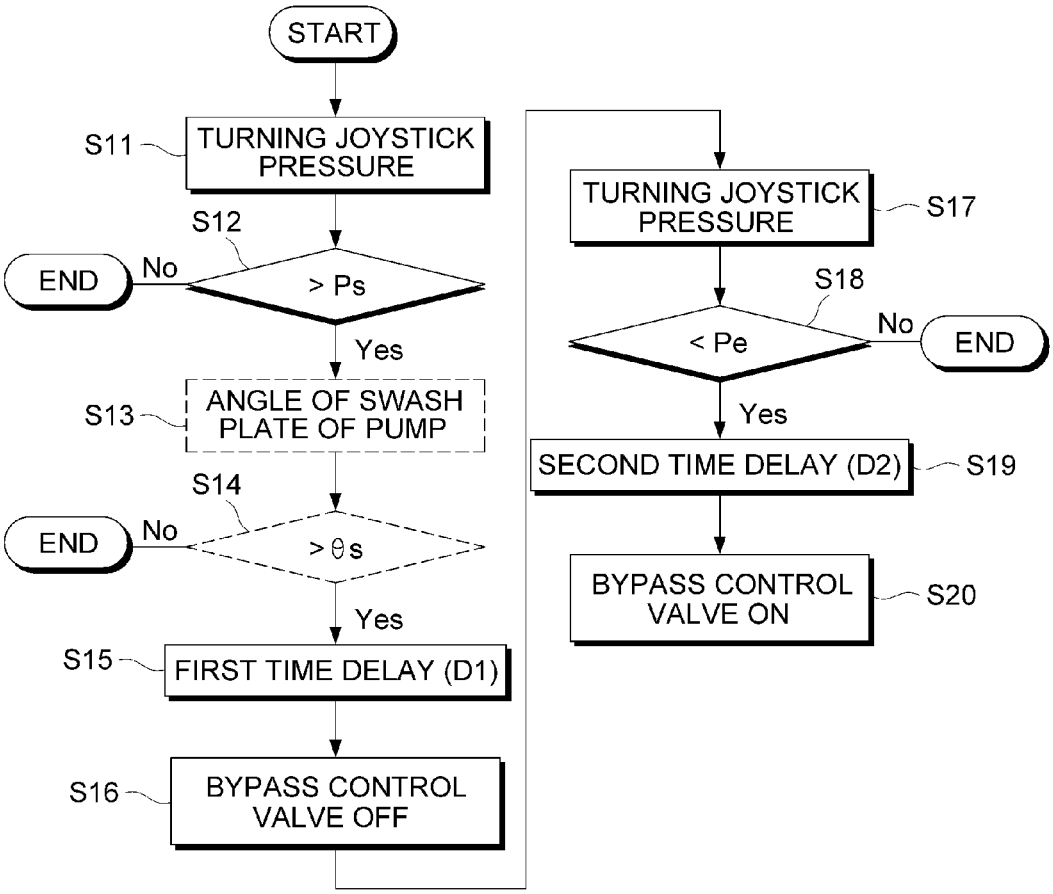
FIGS. 2 and 3 are a flowchart and a view for explaining a method for controlling the hydraulic system of the swing motor according to the first exemplary embodiment of the present disclosure.
Figure 3:
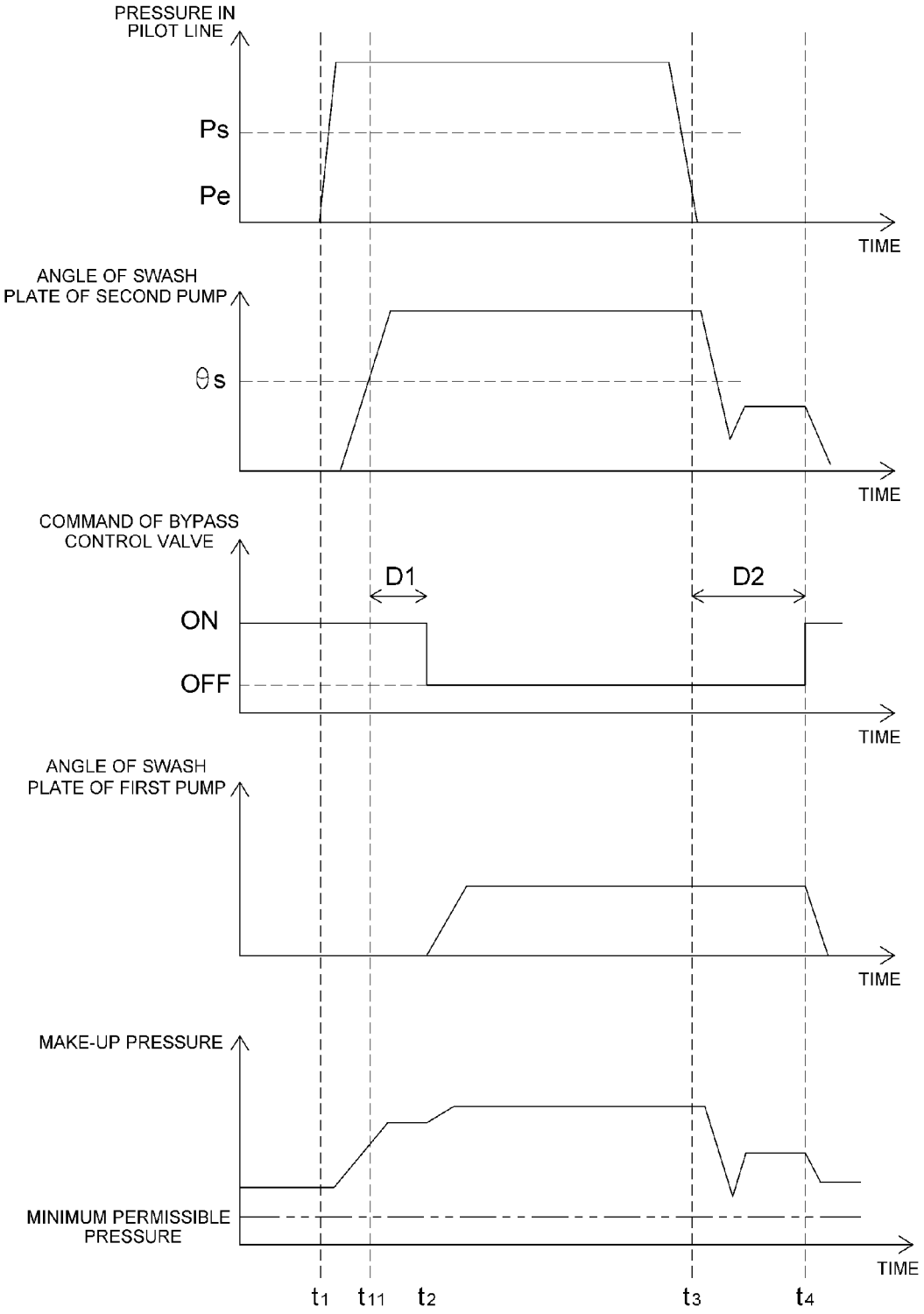

Hereinafter, a method for controlling a swing motor in a hydraulic system and a hydraulic system according to a first exemplary embodiment of the present disclosure will be described with reference to FIGS. 1 to 3.

The attached FIG. 1 is a view illustrating a hydraulic circuit for explaining a hydraulic system of a swing motor according to a first exemplary embodiment of the present disclosure. FIGS. 2 and 3 are a flowchart and a view for explaining a method for controlling the hydraulic system of the swing motor according to the first exemplary embodiment of the present disclosure.

The hydraulic system including the swing motor according to the first exemplary embodiment of the present disclosure includes main pumps, control valve units, bypass cut valves, an auxiliary pump, a bypass control valve, and a control unit.

The main pump discharges hydraulic oil. The main pump operates to increase a discharge flow rate when pilot pressure is increased by an operation of a joystick. A plurality of main pumps including first and second main pumps 11 and 12 may be provided.

First and second swash plate swivel angle detecting units 21 and 22 are provided in the first and second main pumps 11 and 12, respectively. The first and second swash plate swivel angle detecting unit 21 and 22 detect swivel angles of swash plates of the first and second main pumps 11 and 12, and provides the swivel angles to the control unit.

The auxiliary pump 13 discharges pilot hydraulic oil. The pilot hydraulic oil is supplied to a joystick 70, pilot pressure is formed by operating the joystick 70, and the pilot pressure is supplied to each of the control valve units.

The control valve units are disposed on hydraulic lines connected to the main pumps, and controlled so that the hydraulic oil is supplied to the swing motor 60. A plurality of control valve units may be provided in a main control valve 30, and for example, first, second, third, and fourth control valve units 31, 32, 34, and 35 may be provided. One control valve unit of the plurality of control valve units is controlled to supply the hydraulic oil to the swing motor 60. FIG. 1 illustrates that the operation of the swing motor 60 is controlled by the third control valve 34.

That is, when the joystick 70 is operated based on FIG. 1, the pilot hydraulic oil moves a spool of the third control valve unit 34, and as the spool moves, the hydraulic oil is supplied to the swing motor 60. Meanwhile, based on the position of the spool, a direction in which the hydraulic oil is supplied to the swing motor 60 may be changed to a forward direction or a reverse direction, and as a result, the swing motor 60 rotates in the forward direction or the reverse direction.

First and second ports 61 and 62 are formed at both ends of the swing motor 60, respectively. Based on the direction in which the swing motor 60 rotates, one port of the first and second ports 61 and 62 serves as an inlet port into which the hydraulic oil is drawn, and the other port serves as an outlet port from which the hydraulic oil is discharged.

The first and second ports 61 and 62 are connected to the third control valve unit 34 through first and second hydraulic lines 67 and 68, respectively.

In addition, a make-up line 69 is connected to the swing motor 60, and the make-up line 69 is connected to the hydraulic lines connected to the first and second main pumps 11 and 12, respectively.

In addition, a bypass check valve 50 is connected to one side of the make-up line 69. The bypass check valve 50 is opened to discharge the hydraulic oil when the excess amount of hydraulic oil flows in the make-up line 69, and the bypass check valve 50 is maintained in a closed state when negative pressure is formed in the make-up line 69.

In addition, a first check valve 63 is provided between the first hydraulic line 67 and the make-up line 69. The first check valve 63 is opened when negative pressure is formed at the first port 61 so that the hydraulic oil is supplementarily supplied from the make-up line 69 to the first port 61.

Likewise, a second check valve 64 is provided between the second hydraulic line 68 and the make-up line 69. The second check valve 64 is opened when negative pressure is formed at the second port 61 so that the hydraulic oil is supplementarily supplied from the make-up line 69 to the second port 61.

In addition, a first relief valve 65 is provided between the first hydraulic line 67 and the make-up line 69. The first relief valve 65 is opened when abnormal high pressure is formed at the first hydraulic line 67 so that the hydraulic oil is discharged to the make-up line 69.

Likewise, a second relief valve 66 is provided between the second hydraulic line 67 and the make-up line 69. The second relief valve 66 is opened when abnormal high pressure is formed at the second hydraulic line 68 so that the hydraulic oil is discharged to the make-up line 69.

First and second joystick pressure sensors 71 and 72 are provided on a pilot line that connects the joystick 70 and the third control valve unit 34. The first and second joystick pressure sensors 71 and 72 allow a user to know whether the joystick 70 is operated. When the joystick 70 is operated in the forward direction or the reverse direction, pilot pressure is formed in the pilot line.

Meanwhile, the first and second control valve units 31 and 32 may be disposed on the first hydraulic line connected to the first main pump 11, and the third and fourth control valve units 34 and 35 may be disposed on the second hydraulic line connected to the second main pump 12.

The bypass cut valves 33, 36 are disposed, on the hydraulic lines through which the hydraulic oil is discharged from the main pumps, at downstream sides of the control valve units 31, 32, 34, and 35, and the bypass cut valves are maintained in a closed state during operation. When the pilot hydraulic oil is inputted to a pressure receiving part of the bypass cut valve, the bypass cut valve is closed. A plurality of bypass cut valves may be provided. More particularly, referring to FIG. 1, a first bypass cut valve 33 may be disposed on the first hydraulic line, and a second bypass cut valve 36 may be disposed on the second hydraulic line.

That is, when the first bypass cut valve 33 is blocked, pressure is formed in the first hydraulic line that connects the first main pump 11 and the first and second control valve units 31 and 32. In addition, when the second bypass cut valve 36 is blocked, pressure is formed in the second hydraulic line that connects the second main pump 12 and the third and fourth control valve units 34 and 35.

The bypass control valve 40 may be a solenoid valve. In this case, the bypass control valve is maintained in a closed state, and the bypass control valve is opened when electric power is applied to the bypass control valve. The bypass control valve is always opened in a situation in which a construction machine is typically operated.

Hereinafter, the opened state of the bypass control valve is referred to as an "On" state, and the closed state of the bypass control valve is referred to as an "Off" state.

Therefore, in a typical operating state, the bypass control valve 40 is controlled to be in the "On" state, and in this case, the auxiliary pump 13 is connected with the first and second bypass cut valves 33 and 36. That is, the bypass control valve 40 is installed on a flow path that connects the auxiliary pump 13 and the first and second bypass cut valves 33 and 36, prevents the pilot hydraulic oil discharged from the auxiliary pump 13 from being supplied to the first and second bypass cut valves 33 and 36 in the "Off" state, and allows the pilot hydraulic oil discharged from the auxiliary pump 13 to be supplied to the first and second bypass cut valves 33 and 36 in the "On" state. In other words, the bypass control valve 40 connects the auxiliary pump 13 with the first and second bypass cut valves 33 and 36 in the "On" state, and disconnects the auxiliary pump 13 from the first and second bypass cut valves 33 and 36 in the "Off" state. When the pilot hydraulic oil discharged from the auxiliary pump 13 is applied to pressure receiving parts of the first and second bypass cut valves 33 and 36, the first and second bypass cut valves 33 and 36 are closed.

The control unit may control whether to open or close the bypass control valve 40 or control pressure of the bypass control valve 40. That is, the control unit according to the first exemplary embodiment of the present disclosure controls whether to open or close the bypass control valve 40 at any point in time, thereby controlling the swing motor 60.

Hereinafter, a method for controlling the swing motor in the hydraulic system according to the first exemplary embodiment of the present disclosure will be described with reference to FIGS. 2 and 3.

When the joystick 70 is operated to initiate the operation of the swing motor 60, pressure is formed in the pilot line (S11).

Whether the pressure formed in the pilot line is a first pressure Ps is determined (S12).

Thereafter, the bypass control valve 40 is further maintained in the "On" state during a first delay time D1 from a point in time $t_1$ where the pressure formed in the pilot line is the first pressure Ps, and then the state of the bypass control valve 40 is changed to the "Off" state (S15 and S16). That is, the bypass control valve 40 is maintained in the "On" state until a delay point in time $t_2$ after the point in time $t_1$ where the pressure formed in the pilot line is the first pressure Ps, and the state of the bypass control valve 40 is changed to the "Off" state after the delay point in time $t_2$. Here, as the bypass control valve 40 is maintained in the "On" state, the first and second bypass cut valves 33 and 36 are closed, and pressure is formed in the first and second hydraulic lines. Further, the spool of the third control valve unit 34 is moved by the operation of the joystick 70, and as a result, the hydraulic oil discharged from the second main pump 12 is supplied to the swing motor 60. That is, because the hydraulic oil is consumed in the swing motor 60, an angle of the swash plate of the second main pump 12 is gradually increased.

Thereafter, when the state of the bypass control valve 40 is changed from the "On" state to the "Off" state (S16), a discharge flow rate of the hydraulic oil of the first main pump 11 is increased, and the increased discharge flow rate is maintained, and even in this case, an increased discharge flow rate of the hydraulic oil of the second main pump 12 is maintained. As a result, the sufficient amount of hydraulic oil is supplied to the make-up line 69, and thus pressure higher than minimum permissible pressure is maintained.

Thereafter, the joystick 70 does not operate any more in order to stop the operation of the swing motor 60, and the pressure in the pilot line, which is caused by the operation of the joystick 70, is gradually decreased (S17). More particularly, the pressure in the pilot line is decreased from the first pressure Ps to a second pressure Pe. The first pressure Ps may be a typical pressure formed in the pilot line, that is, pressure formed when the joystick 70 normally operates. The second pressure Pe is lower than the first pressure Ps, but even the state in which the second pressure Pe is formed may be appreciated as a state in which pressure is still formed. That is, the second pressure Pe may be very low pressure immediately before the pressure is dissipated.

When the pressure formed in the pilot line reaches the second pressure Pe (S18), the bypass control valve 40 is maintained in the "Off" state during a second delay time D2, and then the state of the bypass control valve 40 is changed to the "On" state (S19 and S20).

Meanwhile, as the operation of the joystick 70 ends, a flow rate of hydraulic oil discharged from the second main pump 12 is gradually decreased.

However, as the bypass control valve 40 is maintained in the "Off" state during the second delay time D2, the first and second main pumps 11 and 12 continue to discharge the hydraulic oil during the second delay time D2 (S20).

As a result, the hydraulic oil is continuously discharged from the first and second main pumps 11 and 12 even though the discharge flow rate is low. That is, since appropriate pressure is formed in the make-up line 69, the pressure higher than the minimum permissible pressure is still maintained.

In particular, a shaft of the swing motor may be continuously rotated by inertia even in a case in which the swing motor 60 is stopped. In this case, the sufficient amount of hydraulic oil having sufficient pressure is ensured in the make-up line 69 even in a case in which negative pressure is formed at the port into which the hydraulic oil is drawn, and as a result, the hydraulic oil may be sufficiently and supplementarily supplied to the port into which the hydraulic oil is drawn. Therefore, the occurrence of cavitation in the swing motor 60 is prevented. In addition, since the hydraulic oil may be stably and continuously supplied to the swing motor 60, it is possible to prevent the occurrence of abnormal noise caused when cavitation occurs.

Meanwhile, whether the pilot pressure reaches the first pressure Ps is determined (S12), and then a value of the swivel angle of the swash plate of the second main pump 12 may be inputted (S13). Whether the swivel angle of the swash plate of the second main pump 12 reaches a preset angle θs is determined (S14), and the bypass control valve 40 is maintained in the "On" state during a first delay time D1' from a point of time $t_{11}$ when the swivel angle of the swash plate of the second main pump 12 reaches the preset angle θs, and then the state of the bypass control valve 40 may be changed to the "Off" state (S15 and S16). That is, the bypass control valve 40 is maintained in the "On" state until the delay point in time t7 after the point in time $t_{11}$ where the swivel angle of the swash plate of the second main pump 12 reaches the preset angle θs, and then the state of the bypass control valve 40 is changed to the "Off" state after the delay point in time $t_2$.

As described above, the determination may be carried out by using both of the pilot pressure (>Ps) formed by the operation of the joystick 70 and the swivel angle (>θs) of the swash plate of the second main pump 12. If the determination is carried out by utilizing information about the swivel angle of the swash plate of the second main pump 12 together as described above, the amount of hydraulic oil may not be bypassed under a condition in which no make-up is necessary such as a condition in which a rotational speed of the swing motor 60 is low. That is, it is possible to improve energy efficiency by preventing the hydraulic oil from being excessively consumed.

Second Exemplary Embodiment

Figure 4:
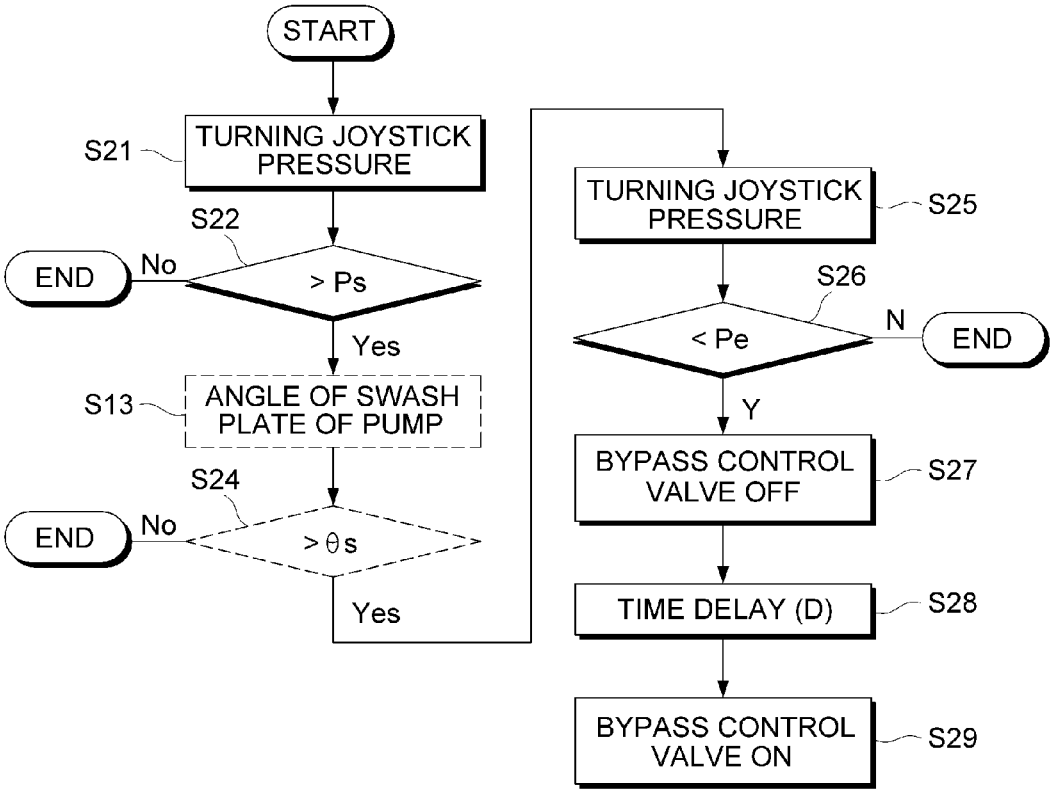
FIGS. 4 and 5 are a flowchart and a view for explaining a method for controlling a hydraulic system of a swing motor according to a second exemplary embodiment of the present disclosure.
Figure 5:
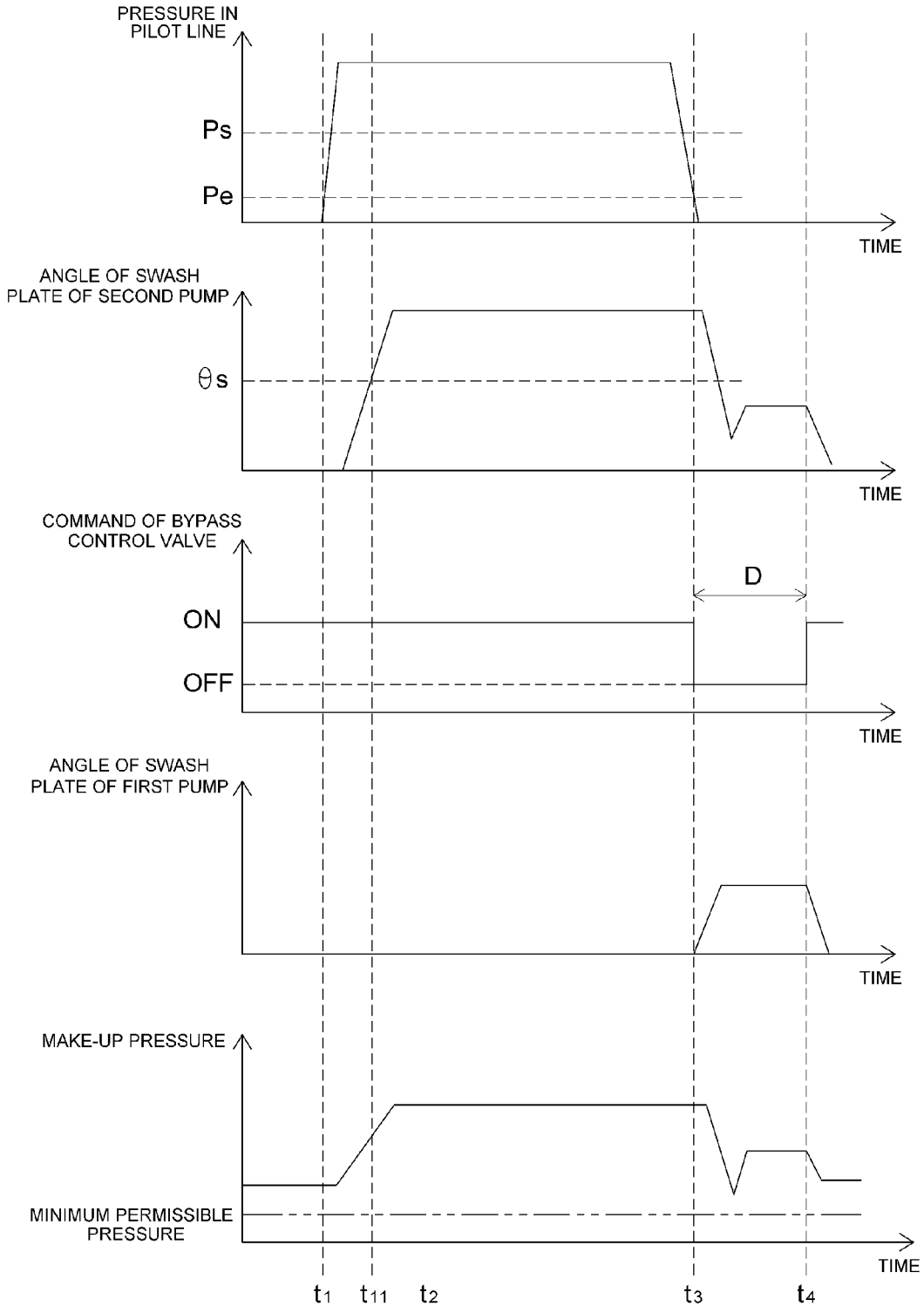

Hereinafter, a method for controlling a swing motor in a hydraulic system and a hydraulic system according to a second exemplary embodiment of the present disclosure will be described with reference to FIGS. 4 to 5. The attached FIGS. 4 and 5 are a flowchart and a view for explaining a method for controlling the hydraulic system including the swing motor according to the second exemplary embodiment of the present disclosure. The second exemplary embodiment of the present disclosure has the same hardware configuration as the first exemplary embodiment of the present disclosure, but differs from the first exemplary embodiment of the present disclosure in terms of a control method. Therefore, the hardware configuration of the second exemplary embodiment will be described with reference to the constituent elements disclosed in the first exemplary embodiment.

When the joystick 70 is operated to initiate the operation of the swing motor 60, pressure is formed in the pilot line (S21). Thereafter, whether the pressure formed in the pilot line is the first pressure Ps is determined (S22). Meanwhile, the bypass control valve 40 is still maintained in the "On" state. In addition, when the pressure in the pilot line becomes the first pressure Ps or higher, the swivel angle of the swash plate of the second main pump 12 is increased, and as a result, the make-up line 69 is maintained in a state in which the pressure is higher than the minimum permissible pressure and the flow rate of hydraulic oil is ensured.

Thereafter, when the joystick 70 does not operate any more so as to end the operation of the swing motor 60, the pressure in the pilot line is changed. A value of the changed pressure in the pilot line is inputted (S25). Thereafter, whether the pressure formed in the pilot line is the second pressure Pe is determined (S26). Here, the state in the which the pressure formed in the pilot line is the second pressure Pe means that the joystick 60 does not operate any more so as to end the operation of the swing motor 60.

Thereafter, the state of the bypass control valve 40 is changed from the "On" state to the "Off" state (S27). The bypass control valve 40 is maintained in the "Off" state during the delay time D from a point in time $t_3$ where the state is changed from the "On" state to the "Off" state (S28). In this case, a discharge flow rate of the hydraulic oil of the first main pump 11 is increased, and the increased discharge flow rate is maintained, and even in this case, the discharge flow rate of the hydraulic oil of the second main pump 12 is decreased, but a predetermined discharge flow rate or higher is ensured and maintained. As a result, sufficient pressure is formed in the make-up line 69, and thus the pressure higher than the minimum permissible pressure is maintained.

Since the bypass control valve 40 is maintained in the "Off" state during the delay time D, the first and second bypass cut valves 33 and 36 are opened. That is, the first and second main pumps 11 and 12 continue to discharge the hydraulic oil while the hydraulic system is operated, and the hydraulic oil discharged from the first and second main pumps 11 and 12 is supplied to the make-up line 69 through the first and second bypass cut valves 33 and 36, and as a result, constant pressure may be maintained in the make-up line 69.

That is, even in a situation in which when the swing motor 60 is stopped after rotating, negative pressure is formed in the port into which the hydraulic oil is drawn and the hydraulic oil needs to be supplementarily supplied, the sufficient amount of hydraulic oil is present in the make-up line 69, and as a result, it is possible to stably and supplementarily supply the hydraulic oil to the swing motor 60.

Thereafter, when the delay time D has passed, the state of the bypass control valve 40 is changed from the "Off" state to the "On" state (S29).

Meanwhile, whether the pilot pressure reaches the first pressure Ps is determined (S22), and then a value of the swivel angle of the swash plate of the second main pump 12 may be inputted (S23). Whether the swivel angle of the swash plate reaches the preset angle θs is determined (S24), and when the pressure in the pilot line is changed by the operation of the joystick 70, a value of the changed pressure in the pilot line may be inputted (S25).

As described above, the determination may be carried out by using information about both of the pilot pressure (>Ps) formed by the operation of the joystick 70 and the swivel angle (>θs) of the swash plate of the second main pump 12. If the determination is carried out by utilizing information about the swivel angle of the swash plate together as described above, the amount of hydraulic oil may not be bypassed under a condition in which no make-up is necessary such as a condition in which a rotational speed of the swing motor 60 is low. That is, it is possible to improve energy efficiency by preventing the hydraulic oil from being excessively consumed.

Third Exemplary Embodiment

Figure 6:
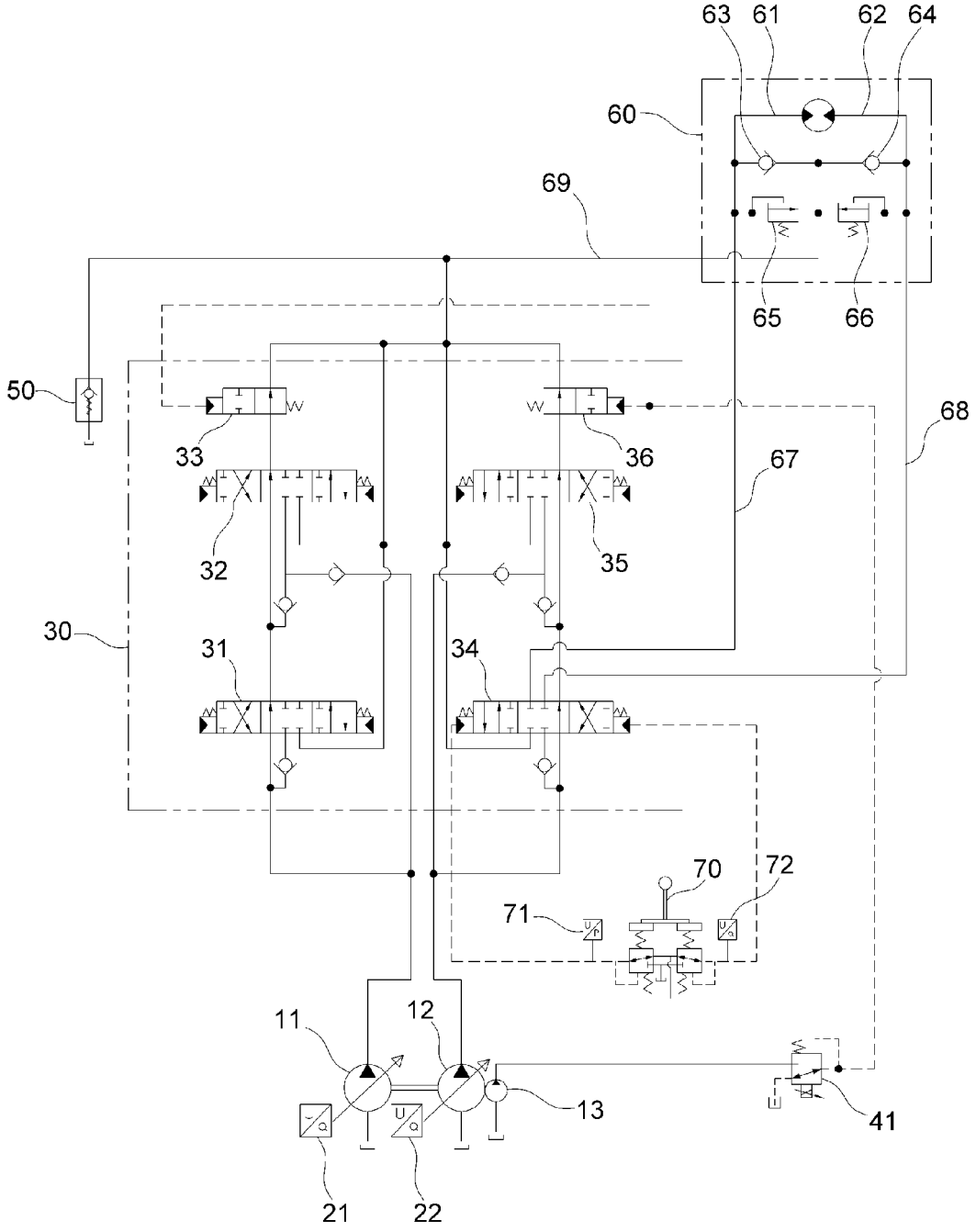
FIG. 6 is a view illustrating a hydraulic circuit for explaining a hydraulic system of a swing motor according to a third exemplary embodiment of the present disclosure.
Figure 7:
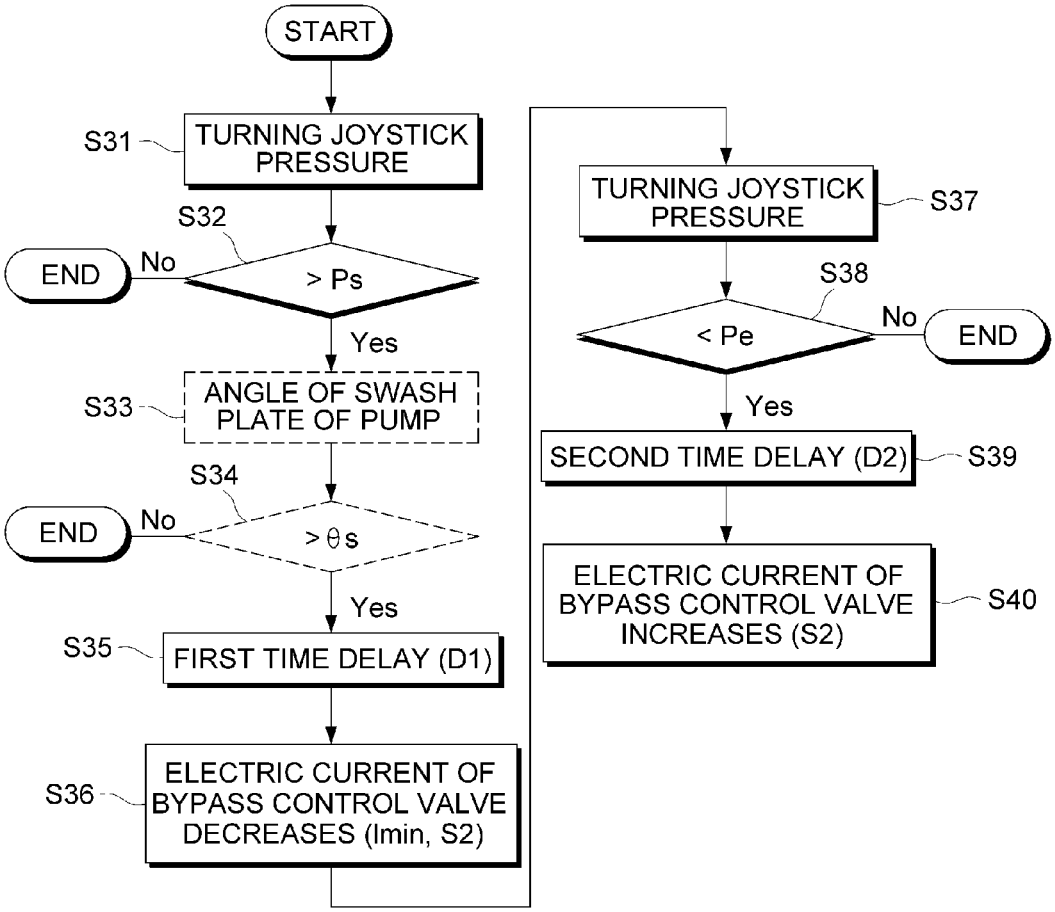
FIGS. 7 and 8 are a flowchart and a view for explaining a method for controlling the hydraulic system of the swing motor according to the third exemplary embodiment of the present disclosure.
Figure 8:
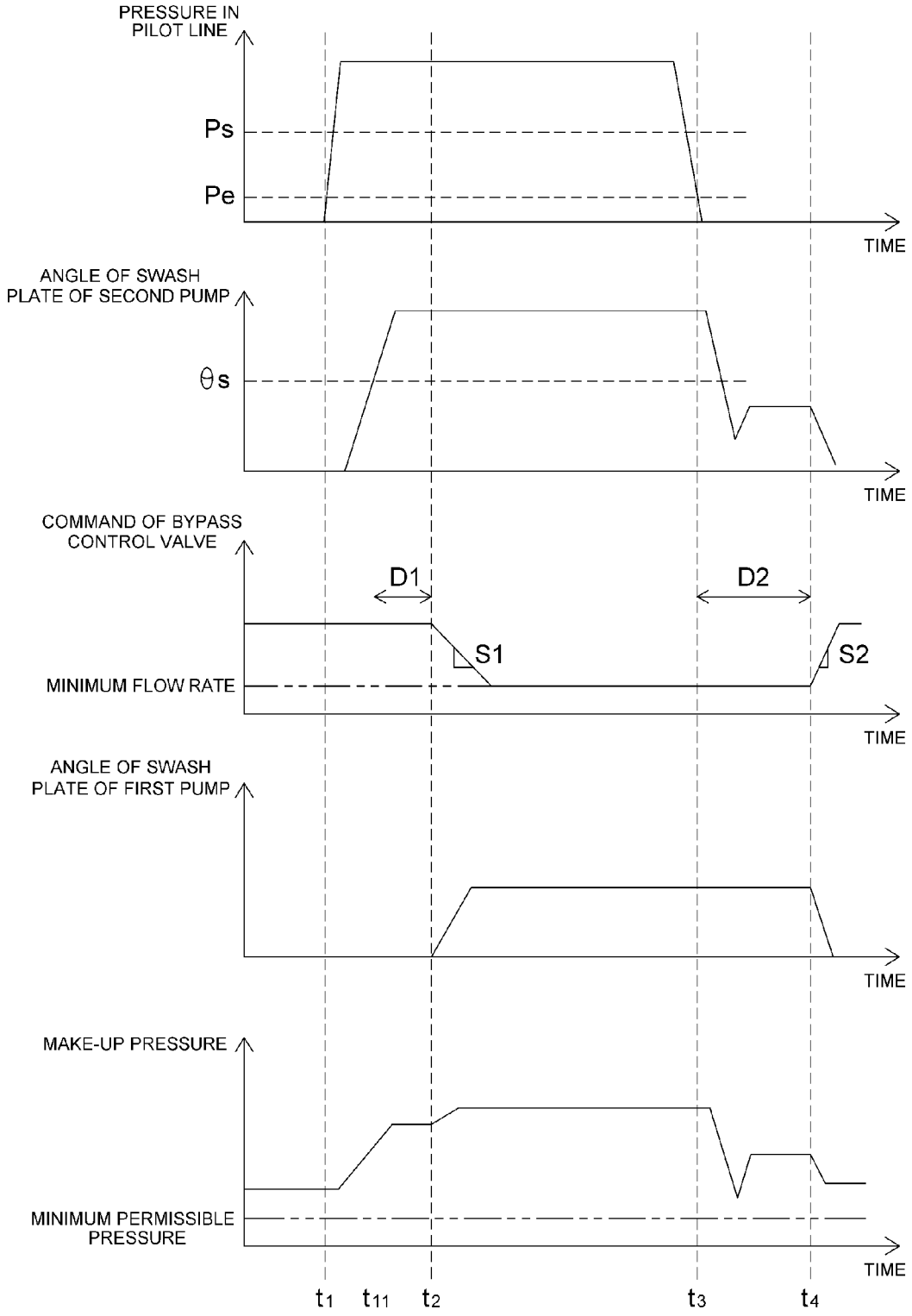

Hereinafter, a method for controlling a swing motor in a hydraulic system and a hydraulic system according to a third exemplary embodiment of the present disclosure will be described with reference to FIGS. 6 to 8. The attached FIG.

6 is a view illustrating a hydraulic circuit for explaining the hydraulic system including the swing motor according to the third exemplary embodiment of the present disclosure. FIGS. 7 and 8 are a flowchart and a view for explaining the method for controlling the hydraulic system including the swing motor according to the third exemplary embodiment of the present disclosure.

The third exemplary embodiment of the present disclosure differs from the first exemplary embodiment of the present disclosure in terms of the configuration of the bypass control valve. That is, the bypass control valve 40 according to the first exemplary embodiment is a solenoid valve in which opening and closing operations thereof are On/Off controlled, but a bypass control valve 41 according to the third exemplary embodiment is an electromagnetic proportional pressure reducing valve of which pressure is controlled in proportion to an electric current value.

Therefore, the third exemplary embodiment of the present disclosure will be described with reference to the hardware of the first exemplary embodiment.

When the joystick 70 is operated to initiate the operation of the swing motor 60, pressure is formed in the pilot line (S31). In this case, a first electric current value is applied to the bypass control valve. Thereafter, whether the pressure formed in the pilot line is the first pressure Ps is determined (S32). In this case, as a magnitude of the electric current value applied to the bypass control valve, the first electric current value is maintained during the first delay time D1 from the point in time $t_1$ where the first pressure Ps is formed in the pilot line. In addition, when the pressure in the pilot line becomes the first pressure Ps or higher, the swivel angle of the swash plate of the second main pump 12 is increased, and as a result, the make-up line 69 is maintained in a state in which the pressure is higher than the minimum permissible pressure and the flow rate of hydraulic oil is ensured.

When the first delay time D1 has passed, the magnitude of the electric current value applied to the bypass control valve is decreased from the first electric current value to a second electric current value (S35 and S36).

The state in which the first electric current is applied to the bypass control valve may correspond to the pressure when the bypass cut valve is fully closed, and the state in which the second electric current is applied to the bypass control valve may correspond to the pressure when the bypass cut valve is slightly opened.

Here, the state in which the second electric current is applied to the bypass control valve 40 is maintained, and as a result, the first and second bypass cut valves 33 and 36 are slightly opened. Further, the spool of the third control valve unit 34 is moved by the operation of the joystick 70, and as a result, the hydraulic oil discharged from the second main pump 12 is supplied to the swing motor 60. That is, because the swing motor 60 consumes the hydraulic oil, the swivel angle of the swash plate of the second main pump 12 is gradually increased, and the increased swivel angle of the swash plate is maintained.

Thereafter, the joystick 70 does not operate any more in order to stop the operation of the swing motor 60, and the pressure in the pilot line of the joystick 70 is gradually decreased (S37). More particularly, the pressure in the pilot line is decreased from the first pressure Ps to the second pressure Pe.

When the pressure formed in the pilot line reaches the second pressure Pe (S38), the magnitude of the electric current value, which is applied to the bypass control valve after the second delay time D2 has passed from the point in time $t_3$ where the pressure formed in the pilot line reaches the second pressure Pe, is increased from the second electric current value to the first electric current value (S39 and S40).

Meanwhile, as the operation of the joystick 70 ends, a flow rate of the hydraulic oil discharged from the second main pump 12 is gradually decreased.

However, the magnitude of the electric current value applied to the bypass control valve 41 is increased from the second electric current value to the first electric current value after the second delay time D2 has passed from the point in time $t_3$ where the pressure formed in the pilot line reaches the second pressure Pe, and as a result, the first and second main pumps 11 and 12 continue to discharge the hydraulic oil (S40).

As a result, the hydraulic oil is continuously discharged from the first and second main pumps 11 and 12 even though the discharge flow rate is low. Therefore, since appropriate pressure is formed in the make-up line 69, the pressure higher than the minimum permissible pressure is still maintained.

In particular, the shaft of the swing motor 60 may be continuously rotated by inertia even in a case in which the swing motor 60 is stopped after rotating. In this case, the sufficient amount of hydraulic oil having sufficient pressure is ensured in the make-up line 69 even in a case in which negative pressure is formed at the port into which the hydraulic oil is drawn, and as a result, the hydraulic oil may be sufficiently and supplementarily supplied to the port into which the hydraulic oil is drawn. Therefore, the occurrence of cavitation in the swing motor 60 is prevented. In addition, since the hydraulic oil may be stably and continuously supplied to the swing motor 60, it is possible to prevent the occurrence of abnormal noise caused when cavitation occurs.

Meanwhile, whether the pilot pressure reaches the first pressure Ps is determined (S32), and then a value of the swivel angle of the swash plate of the second main pump 12 may be inputted (S33). Whether the swivel angle of the swash plate reaches the preset angle θs is determined (S34), and the magnitude of the electric current value applied to the bypass control valve 41 may be decreased from the first electric current value to the second electric current value after the first delay time D1' has passed from the point in time $t_{11}$ where the swivel angle of the swash plate of the second main pump 12 reaches the preset angle θs (S35 and S36).

As described above, the determination may be carried out by using information about both of the pilot pressure (>Ps) formed by the operation of the joystick 70 and the swivel angle (>θs) of the swash plate of the second main pump 12. If the determination is carried out by utilizing information about the swivel angle of the swash plate together as described above, the amount of hydraulic oil may not be bypassed under a condition in which no make-up is necessary such as a condition in which a rotational speed of the swing motor 60 is low. That is, it is possible to improve energy efficiency by preventing the hydraulic oil from being excessively consumed.

Meanwhile, when the magnitude of the electric current value applied to the bypass control valve 41 is decreased from the first electric current value to the second electric current value (S36), a downward gradient S1 may be set. In addition, when the magnitude of the electric current value applied to the bypass control valve 41 is increased from the second electric current value to the first electric current value (S40), an upward gradient S2 may be set.

That is, by setting the downward gradient S1 or the upward gradient S2, it is possible to prevent opening degrees of the bypass cut valves 33 and 36 from being rapidly changed, and prevent impact caused by the rapid change in opening degree.

Fourth Exemplary Embodiment

Figure 9:
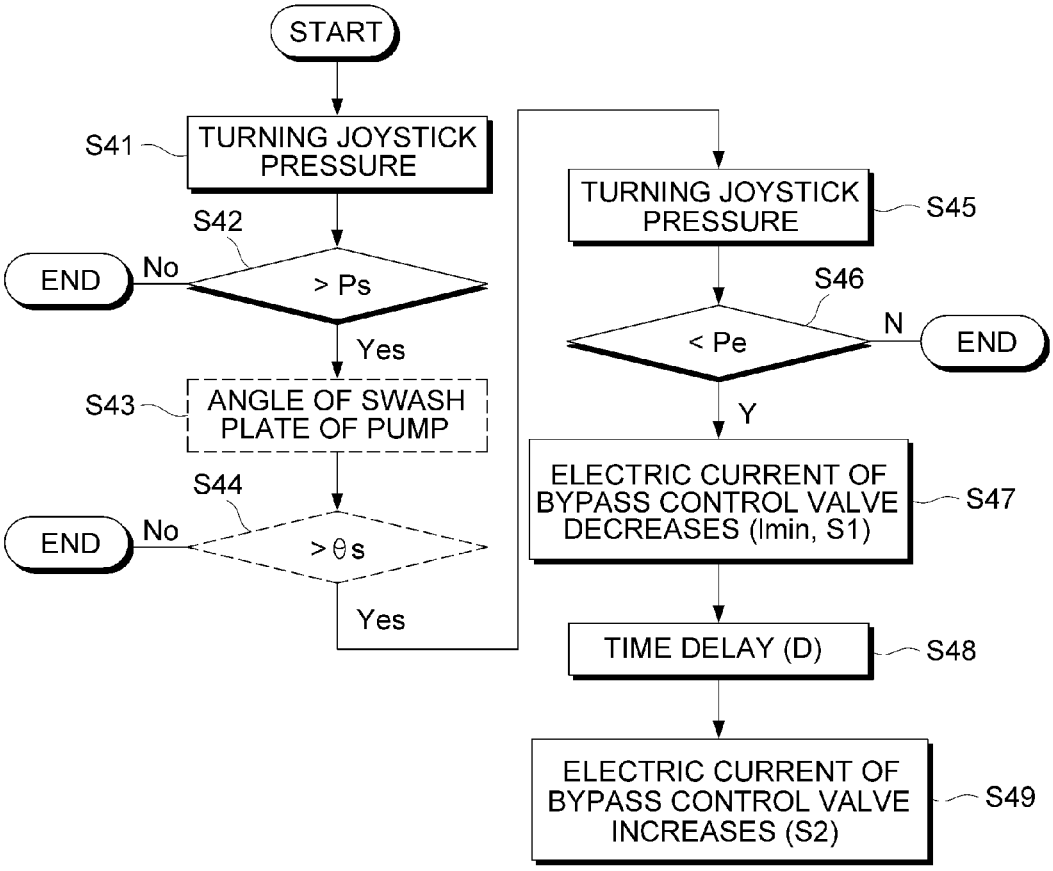
FIGS. 9 and 10 are a flowchart and a view for explaining a method for controlling a hydraulic system of a swing motor according to a fourth exemplary embodiment of the present disclosure.
Figure 10:
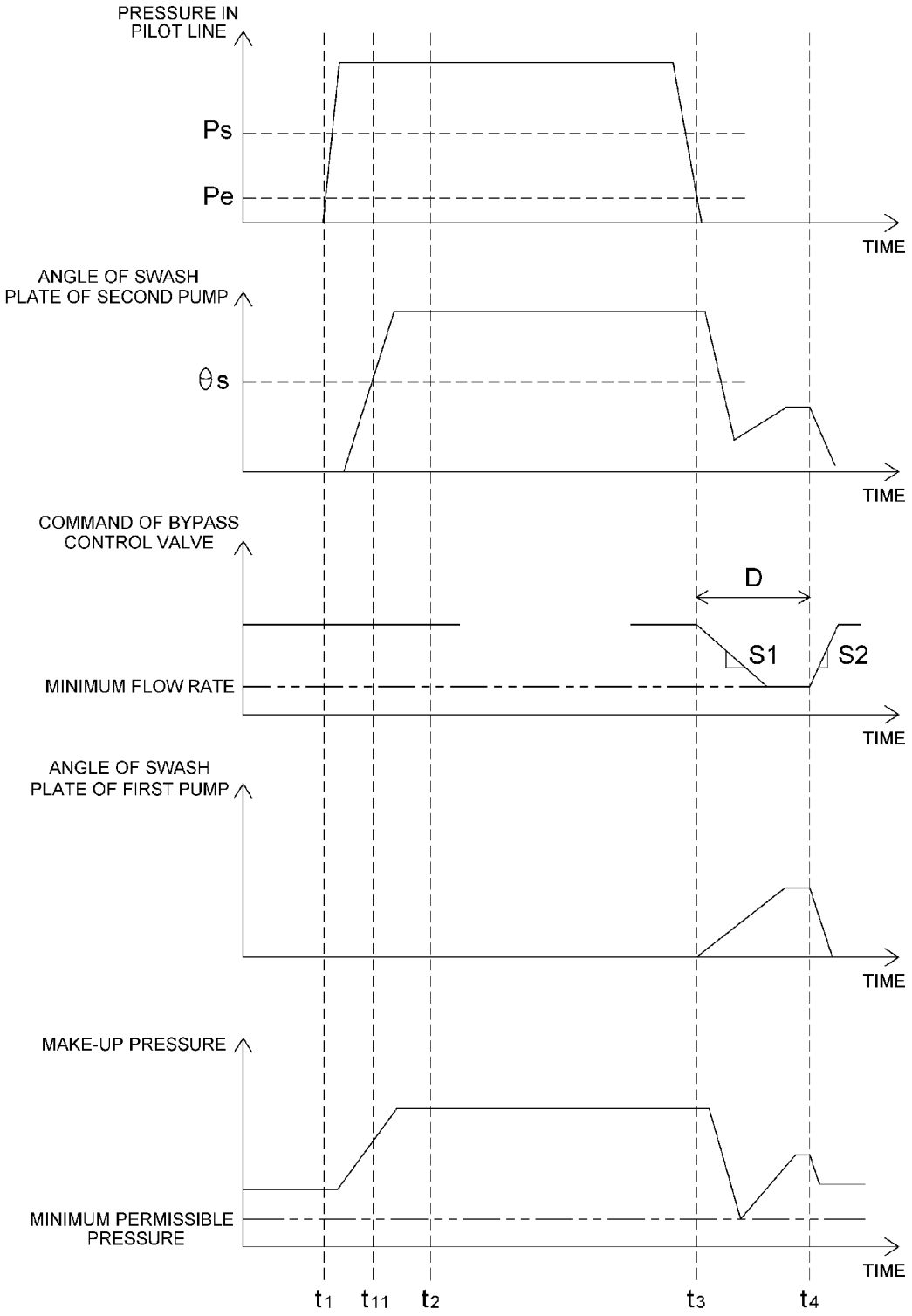

Hereinafter, a method for controlling a swing motor in a hydraulic system and a hydraulic system according to a fourth exemplary embodiment of the present disclosure will be described with reference to FIGS. 9 to 10. The attached FIGS. 9 and 10 are a flowchart and a view for explaining a method for controlling the hydraulic system including the swing motor according to the fourth exemplary embodiment of the present disclosure.

The fourth exemplary embodiment of the present disclosure has the same hardware configuration as the third exemplary embodiment of the present disclosure, but differs from the third exemplary embodiment of the present disclosure in terms of a control method.

Therefore, the fourth exemplary embodiment of the present disclosure will be described with reference to the hardware of the third exemplary embodiment.

When the joystick 70 is operated to initiate the operation of the swing motor 60, pressure is formed in the pilot line (S41). In this case, the first electric current value is applied to the bypass control valve. Thereafter, whether the pressure formed in the pilot line is the first pressure Ps is determined (S42). In this case, as the magnitude of the electric current value applied to the bypass control valve, the first electric current value is maintained. In addition, when the pressure in the pilot line becomes the first pressure Ps or higher, the swivel angle of the swash plate of the second main pump 12 is increased, and as a result, the make-up line 69 is maintained in a state in which the pressure is higher than the minimum permissible pressure and the flow rate of hydraulic oil is ensured.

Thereafter, when the joystick 70 does not operate any more so as to end the operation of the swing motor 60, the pressure in the pilot line is changed. A value of the changed pressure in the pilot line is inputted (S45). Thereafter, whether the pressure formed in the pilot line is decreased and reaches the second pressure Pe is determined (S46). Here, the state in which the pressure formed in the pilot line is the second pressure Pc means that the joystick 60 does not operate any more so as to end the operation of the swing motor 60.

The magnitude of the electric current value applied to the bypass control valve is decreased from the first electric current value to the second electric current value from the point in time $t_3$ where the pressure formed in the pilot line reaches the second pressure Pe (S47). The magnitude of the electric current value applied to the bypass control valve 41 is decreased from the first electric current value to the second electric current value during the delay time D from the point in time $t_3$ where the pressure formed in the pilot line reaches the second pressure Pe (S48). In this case, a discharge flow rate of the hydraulic oil of the first main pump 11 is increased, and the increased discharge flow rate is maintained, and even in this case, the discharge flow rate of the hydraulic oil of the second main pump 12 is decreased, but a predetermined discharge flow rate or higher is ensured and maintained. As a result, sufficient pressure is formed in the make-up line 69, and thus the pressure higher than the minimum permissible pressure is maintained.

As the magnitude of the electric current value applied to the bypass control valve 41 is decreased from the first electric current value to the second electric current value during the delay time D, the first and second bypass cut valves 33 and 36 are opened. That is, the first and second main pumps 11 and 12 continue to discharge the hydraulic oil while the hydraulic system is operated, and the hydraulic oil discharged from the first and second main pumps 11 and 12 is supplied to the make-up line 69 through the first and second bypass cut valves 33 and 36, and as a result, constant pressure may be maintained in the make-up line 69.

That is, even in a situation in which when the swing motor 60 is stopped after rotating, negative pressure is formed in the port into which the hydraulic oil is drawn and the hydraulic oil needs to be supplementarily supplied, the sufficient amount of hydraulic oils present in the make-up line 69, and as a result, it is possible to stably and supplementarily supply the hydraulic oil to the swing motor 60.

Thereafter, when the delay time D has passed, the magnitude of the electric current value applied to the bypass control valve 41 is increased from the second electric current value to the first electric current value (S49).

Meanwhile, whether the pilot pressure reaches the first pressure Ps is determined (S42), and then a value of the swivel angle of the swash plate of the second main pump 12 may be inputted (S43). Whether the swivel angle of the swash plate reaches the preset angle θs is determined (S44), and when the pressure in the pilot line is changed by the operation of the joystick 70, a value of the changed pressure in the pilot line may be inputted (S45).

As described above, the determination may be carried out by using information about both of the pilot pressure (>Ps) formed by the operation of the joystick 70 and the swivel angle (>θs) of the swash plate of the second main pump 12. If the determination is carried out by utilizing information about the swivel angle of the swash plate together as described above, the amount of hydraulic oil may not be bypassed under a condition in which no make-up is necessary such as a condition in which a rotational speed of the swing motor 60 is low. That is, it is possible to improve energy efficiency by preventing the hydraulic oil front being excessively consumed.

Meanwhile, when the magnitude of the electric current value applied to the bypass control valve 41 is decreased from the first electric current value the second electric current value (S36), the downward gradient S1 may be set. In addition, when the magnitude of the electric current value applied to the bypass control valve 41 is increased from the second electric current value to the first electric current value (S40), the upward gradient S2 may be set.

That is, by setting the downward gradient S1 or the upward gradient S2, it is possible to prevent opening degrees of the bypass cut valves 33 and 36 from being rapidly changed, and prevent impact caused by the rapid change in opening degree.

The method for controlling the swing motor in the hydraulic system and the hydraulic system according to the exemplary embodiment of the present disclosure, which are configured as described above, may ensure the sufficient amount of the hydraulic oil in the make-up line. Therefore, it is possible to prevent the occurrence of cavitation in the swing motor by stably supplying the amount of hydraulic oil at the point in time where the hydraulic oil needs to be supplementarily supplied to the swing motor. In addition, it is possible to prevent the occurrence of abnormal noise which is harsh to the ear when the cavitation occurs.

The exemplary embodiment of the present disclosure has been described with reference to the accompanying drawings, but those skilled in the art will understand that the present disclosure may be carried out in any other specific form without changing the technical spirit or an essential feature thereof.

Accordingly, it should be understood that the aforementioned exemplary embodiment is described for illustration in all aspects and is not limited, and the scope of the present disclosure shall be represented by the claims to be described below, and it should be construed that all of the changes or modified forms induced from the meaning and the scope of the claims, and an equivalent concept thereto are included in the scope of the present disclosure.

INDUSTRIAL APPLICABILITY

The method for controlling the swing motor in the hydraulic system according to the present disclosure may be used for preventing the occurrence of cavitation in the swing motor by supplying the hydraulic oil to the swing motor when the swing motor is stopped after rotating.

The invention claimed is:

1. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an ON state, and to disconnect the auxiliary pump from the bypass cut valve in an OFF state; a joystick which is operated to supply the pilot hydraulic oil to the control valve unit; and a control unit which controls the bypass control valve, wherein the method comprises:

controlling the bypass control valve such that after the bypass control valve is maintained in the ON state during a first delay time D1 from a point in time $t_1$ where a first pressure Ps is formed in a pilot line by the operation of the joystick, the state of the bypass control valve is changed to the OFF state, after the first delay time D1 has passed, the state of the bypass control valve is maintained in the OFF state from a point in time $t_3$ where the pressure formed in the pilot line is decreased and reaches a second pressure Pe lower than the first pressure Ps during a second delay time D2, and then the bypass control valve is changed from the OFF state to the ON state after the second delay time D2 has passed to present a sufficient amount of hydraulic oil in the make-up line to stably and supplementarily supply the hydraulic oil to the swing motor.

2. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an ON state, and to disconnect the auxiliary pump from the bypass cut valve in an OFF state; a joystick which is operated to supply the pilot hydraulic oil to the control valve unit; and a control unit which controls the bypass control valve, wherein the method comprises:

controlling the bypass control valve such that after the bypass control valve is maintained in the ON state during a first delay time D1' from a point in time $t_{11}$ where a first pressure Ps is formed in a pilot line by the operation of the joystick and a swivel angle of a swash plate of the main pump reaches a preset angle θs, the state of the bypass control valve is changed to the OFF state after the first delay time D1' has passed, and then the state of the bypass control valve is maintained in the OFF state from a point in time $t_3$ where the pressure formed in the pilot line is decreased and reaches a second pressure Pe lower than the first pressure Ps during a second delay time D2, and then the bypass control valve is changed from the OFF state to the ON state after the second delay time D2 has passed to present a sufficient amount of hydraulic oil in the make-up line to stably and supplementarily supply the hydraulic oil to the swing motor.

3. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an ON state, and to disconnect the auxiliary pump from the bypass cut valve in an OFF state; a joystick which is operated to supply the pilot hydraulic oil to the control valve unit; and a control unit which controls the bypass control valve, wherein the method comprises:

controlling the bypass control valve such that after the bypass control valve is maintained in the ON state from a point in time $t_1$ where a first pressure Ps is formed in a pilot line by the operation of the joystick to a point in time $t_3$ where the pressure formed in the pilot line is decreased and reaches a second pressure Pe lower than the first pressure Ps, the state of the bypass control valve is changed to the OFF state at the point in time $t_3$ where the pressure formed in the pilot line reaches the second pressure Pe, and the bypass control valve is maintained in the OFF state during a delay time D, and then the state of the bypass control valve is changed to the ON state to present a sufficient amount of hydraulic oil in the make-up line to stably and supplementarily supply the hydraulic oil to the swing motor.

4. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve which is controlled to connect the auxiliary pump and the bypass cut valve in an ON state, and to disconnect the auxiliary pump from the bypass cut valve in an OFF state; a joystick which is operated to supply the pilot hydraulic oil to the control valve unit; and a control unit which controls the bypass control valve, wherein the method comprises:

controlling the bypass control valve such that after the bypass control valve is maintained in the ON state from a point in time $t_{11}$ where a first pressure Ps is formed in a pilot line by the operation of the joystick and a swivel angle of a swash plate of the main pump reaches a preset angle θs to a point in time $t_3$ where the pressure formed in the pilot line is decreased and reaches a second pressure Pe lower than the first pressure Ps, the state of the bypass control valve is changed to the OFF state at the point in time $t_3$ where the pressure formed in the pilot line reaches the second pressure Pe, and the bypass control valve is maintained in the OFF state during a delay time D, and then the state of the bypass control valve is changed to the ON state to present a sufficient amount of hydraulic oil in the make-up line to stably and supplementarily supply the hydraulic oil to the swing motor.

5. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, wherein the method comprises:

controlling the magnitude of the electric current value applied to the bypass control valve such that the magnitude of the electric current value is decreased from a first electric current value to a second electric current value after a first delay time D1 has passed from a point in time $t_1$ where a first pressure Ps is formed in a pilot line by the operation of the joystick, and the magnitude of the electric current value is increased from the second electric current value to the first electric current value after a second delay time D2 has passed from a point in time $t_3$ where the pressure formed in the pilot line is decreased and reaches a second pressure Pe lower than the first pressure Ps to present a sufficient amount of hydraulic oil in the make-up line to stably and supplementarily supply the hydraulic oil to the swing motor.

6. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, wherein the method comprises:

controlling the magnitude of the electric current value applied to the bypass control valve such that the magnitude of the electric current value is decreased from a first electric current value to a second electric current value after a first delay time D1' has passed from a point in time $t_{11}$ where a first pressure Ps is formed in a pilot line by the operation of the joystick and a swivel angle of a swash plate of the main pump reaches a preset angle θs, and the magnitude of the electric current value is increased from the second electric current value to the first electric current value after a second delay time D2 has passed from a point in time $t_3$ where the pressure formed in the pilot line is decreased and reaches a second pressure Pe lower than the first pressure Ps to present a sufficient amount of hydraulic oil in the make-up line to stably and supplementarily supply the hydraulic oil to the swing motor.

7. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, wherein the method comprises:

controlling the magnitude of the electric current value applied to the bypass control valve such that after the magnitude of the electric current value is maintained as a first electric current value from a point in time $t_1$ where a first pressure Ps is formed in a pilot line by the operation of the joystick to a point in time $t_3$ where the pressure formed in the pilot line is decreased and reaches a second pressure Pe lower than the first pressure Ps, the magnitude of the electric current value is decreased to a second electric current value during a delay time D after the point in time $t_3$, the magnitude of the electric current value is increased from the second electric current value to the first electric current value after the delay time D has passed, and then the first electric current value is maintained to present a sufficient amount of hydraulic oil in the make-up line to stably and supplementarily supply the hydraulic oil to the swing motor.

8. A method for controlling a swing motor in a hydraulic system, the hydraulic system comprising: a main pump which discharges hydraulic oil; an auxiliary pump which discharges pilot hydraulic oil; a control valve unit which is disposed on a hydraulic line connected to the main pump and is controlled to supply the hydraulic oil to the swing motor; a make-up line which is connected to the swing motor, and is connected to the hydraulic line connected to the main pump; a bypass cut valve which is disposed on the hydraulic line at a downstream side of the control valve unit and is closed when the pilot hydraulic oil discharged from the auxiliary pump is supplied; a bypass control valve of which output pressure is controlled in proportion to a magnitude of an electric current value and which is controlled to connect the auxiliary pump and the bypass cut valve when electric current is applied; a joystick which is operated to supply the pilot hydraulic oil to the control valve unit; and a control unit which controls the bypass control valve, wherein the method comprises:

controlling the magnitude of the electric current value applied to the bypass control valve such that after the magnitude of the electric current value is maintained as a first electric current value from a point in time $t_{11}$ where a first pressure Ps is formed in a pilot line by the operation of the joystick and a swivel angle of a swash plate of the main pump reaches a preset angle θs to a point in time $t_3$ where the pressure formed in the pilot line is decreased and reaches a second pressure Pe lower than the first pressure Ps, the magnitude of the electric current value is decreased to a second electric current value during a delay time D after the point in time $t_3$, and the magnitude of the electric current value is increased from the second electric current value to the first electric current value after the delay time D has passed, and then the first electric current value is maintained to present a sufficient amount of hydraulic oil in the make-up line to stably and supplementarily supply the hydraulic oil to the swing motor.

9. The method of claim 5, wherein a downward gradient S1 is set when the magnitude of the electric current value applied to the bypass control valve is changed from the first electric current value to the second electric current value, and an upward gradient S2 is set when the magnitude of the electric current value is changed from the second electric current value to the first electric current value.

10. A hydraulic system which adopts the method for controlling the swing motor according to claim 9.

11. A hydraulic system which adopts the method for controlling the swing motor according to claim 1.

* * * * *